US007198086B2

(12) United States Patent
Dusich

(10) Patent No.: US 7,198,086 B2
(45) Date of Patent: Apr. 3, 2007

(54) TAPE DISPENSER

(76) Inventor: Jerry Dusich, 5117 W. 87th La., Crown Point, IN (US) 46307

( * ) Notice: Subject to any disclaimer, the term of this patent is extended or adjusted under 35 U.S.C. 154(b) by 315 days.

(21) Appl. No.: 10/711,246

(22) Filed: Sep. 3, 2004

(65) Prior Publication Data

US 2005/0050840 A1 Mar. 10, 2005

Related U.S. Application Data

(60) Provisional application No. 60/481,335, filed on Sep. 5, 2003.

(51) Int. Cl.
*B32B 37/22* (2006.01)

(52) U.S. Cl. ..... 156/527; 156/525; 156/574; 156/577; 156/579

(58) Field of Classification Search ..... 156/71, 156/523, 526, 574, 577, 579, 527, 525
See application file for complete search history.

(56) References Cited

U.S. PATENT DOCUMENTS

| | | | | | |
|---|---|---|---|---|---|
| 314,798 | A * | 3/1885 | Case | 156/577 |
| 1,901,908 | A * | 3/1933 | Hoyos | 156/155 |
| 2,192,634 | A * | 3/1940 | Blomquist | 156/494 |
| 2,235,704 | A * | 3/1941 | Gorbatenko et al. | 156/499 |
| 2,500,583 | A * | 3/1950 | Smith | 156/575 |
| 3,027,292 | A * | 3/1962 | Rothenberger | 156/468 |
| 3,265,553 | A * | 8/1966 | Wilhelm et al. | 156/384 |
| 3,306,806 | A * | 2/1967 | Seropian | 156/523 |
| 3,399,100 | A * | 8/1968 | Rothenberger | 156/523 |
| 3,463,694 | A * | 8/1969 | De Roshia | 156/523 |
| 3,483,064 | A * | 12/1969 | Coats, Jr. et al. | 156/577 |
| 4,591,407 | A * | 5/1986 | Samuelson | 156/527 |
| 5,403,414 | A * | 4/1995 | Corston | 156/71 |
| 6,045,639 | A * | 4/2000 | Davis | 156/62 |
| 6,484,781 | B2 * | 11/2002 | Weaver | 156/577 |
| 6,681,827 | B2 * | 1/2004 | Tamai et al. | 156/577 |
| 2003/0094243 | A1 * | 5/2003 | Charriere et al. | 156/577 |
| 2004/0200559 | A1 * | 10/2004 | Richards et al. | 156/71 |
| 2005/0028941 | A1 * | 2/2005 | Flowers | 156/574 |

* cited by examiner

*Primary Examiner*—Mark A. Osele
(74) *Attorney, Agent, or Firm*—Gary M. Hartman; Domenica N. S. Hartman; Hartman & Hartman, P.C.

(57) ABSTRACT

A dispenser and method for applying self-adhesive tapes to surfaces of construction lumber, such that pieces of lumber can be accurately located to each other. The dispenser includes a frame comprising spaced-apart member and a roll of adhesive tape rotatably mounted between the spaced-apart members so that the tape is dispensed from the roll and travels toward a rearward end of the frame. Guides are pivotably attached to the spaced-apart members of the frame, with each guide attached so that a portion thereof is pivotable to a position below the lower edge of its respective spaced-apart member. A resilient member is disposed between the lower edges of the spaced-apart members and applieds a downward pressure on the tape as it travels beneath the frame. The tape has symbols and numerical information along a length thereof for locating the pieces of lumber relative to each other.

30 Claims, 3 Drawing Sheets

TAPE DISPENSER

This application claims the benefit of U.S. Provisional Application No. 60/481,335, filed Sep. 5, 2003.

BACKGROUND OF THE INVENTION

The present invention generally relates to tools and methods used in the construction industry. More particularly, this invention relates to a dispenser and a method of dispensing a tape that facilitates locating wall studs, joists, rafters, etc., during building construction.

During the typical construction of a building using lumber, a significant amount of time and attention must be given to ensuring that wall studs, joists, rafters, etc., are properly positioned relative to the structures to which they are fastened, such as ceiling and floor plates, collar beams, ridge beams, etc. Efforts have been made to provide systems that simplify this process to some extent, examples of which include U.S. Pat. No. 4,149,320 to Troyer et al., U.S. Pat. No. 4,367,590 to Winter et al., U.S. Pat. No. 4,845,858 to Thomas, U.S. Pat. No. 4,942,670 to Brandt, and U.S. Pat. No. 5,012,590 to Wagner et al. These patents generally disclose adhesive-backed tapes that carry symbols and/or numerical scales. In use, the tapes are, for example, applied to ceiling/floor plates, to indicate the proper placement of wall studs against the plates. As a particular example, Winter et al.'s tape is applied simultaneously to the edges of a pair of floor and ceiling plates held side-by-side, and is cut down its center during its application so that the plates are marked simultaneously for locating wall studs to the plates once separated.

The prior art has also proposed dispensers capable of dispensing tapes of the types noted above on floor/ceiling plates, ridge beams, and collar beams, etc. Examples include U.S. Pat. No. 3,567,557 to Kingery, U.S. Pat. No. 5,254,203 to Corston, and U.S. Pat. No. 6,494,014 to Lafrance. These patents generally disclose such features as a paddle (tongue) for applying pressure to the dispensed tape, and guides for locating the dispenser and tape along an edge of the surface to which the tape is being applied.

Thought the above patents address certain building construction issues, further improvements would be desirable, particularly with respect to the construction and functionality of the dispensers and tapes capable of use for complicated joint orientations, such as the attachment of rafters to ridge beams for roofs of different pitches and types, etc.

BRIEF SUMMARY OF THE INVENTION

The present invention provides a dispenser and method for applying a specially-designed self-adhesive tape to the surfaces of construction lumber, such that pieces of lumber can be accurately located to each other (for example, wall studs to floor and ceiling plates, floor joists to collar beams, ceiling joists to top ceiling plates, common roof rafters to a ridge beam, jack rafters to hip and valley rafters, jack studs to a gable end rafter, etc.).

The dispenser includes a frame comprising spaced-apart members, each having a lower edge. The frame has a lower forward end in a forward direction of the frame and a lower rearward end in an oppositely-disposed rearward direction of the frame. A roll of an adhesive tape is rotatably mounted between the spaced-apart members so that the tape is dispensed from the roll and travels from the forward end to the rearward end of the frame. The tape has symbols and numerical information along a length thereof. Lateral guides are pivotably attached to the space-apart members of the frame, with each lateral guide being attached so that a portion thereof is pivotable to a position below the lower edge of its respective spaced-apart member. A resilient member is disposed between the lower edges of the spaced-apart members and applies a downward pressure on the tape as it travels from the forward end to the rearward end of the frame. The frame is further equipped with a means for severing the tape at the rearward end of the frame, and a handle adapted for pushing the frame in the forward direction.

The method of this invention is adapted for positioning and orienting a first structural member of a building roof to a second structural member of the roof so as to form a joint between the first and second roof structural members corresponding to a pitch angle of the roof. The method includes applying to a surface of the second structural member a tape having regularly spaced-apart non-rectangular symbols thereon. Each of the symbols has a dimension associated with the pitch angle of the roof. An end of the first structural member is then abutted against the surface of the second structural member so that the end of the first structural member coincides with one of the symbols on the tape. Finally, the first structural member is secured to the second structural member.

In view of the above, it can be seen that the present invention provides dispensers and tapes adapted to provide symbols and numerical information that are useful during residential and commercial construction, and capable of eliminating measurement errors in certain phases of construction. In so doing, the invention significantly reduces the time involved in the preparation and physical marking of measurements for the location and placement of floor joists, wall studs, ceiling joists, roof rafters, etc. The invention can also be used to locate the placement of wall studs on a concave or convex wall. The numerical information can be in the form of a measurement system with increments in British or metric units, and can be adapted to essentially any building convention and building code.

Other objects and advantages of this invention will be better appreciated from the following detailed description.

DETAILED DESCRIPTION OF THE INVENTION

Figure 1:
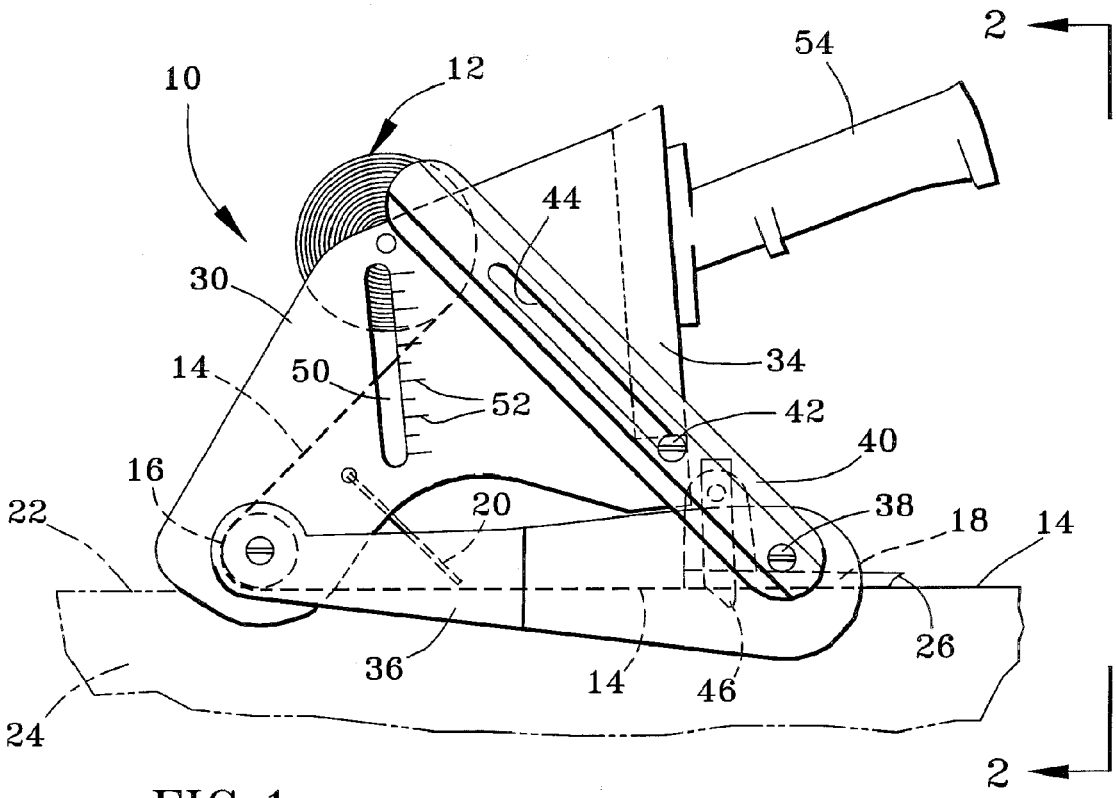
FIGS. 1 and 2 are side and rear views, respectively, of a tape dispenser in accordance with a first embodiment of this invention.

Illustrated in FIGS. 1 through 4 are two preferred embodiments of a tape dispenser system in accordance with this invention. With reference to the first embodiment of FIGS. 1 and 2, a dispenser 10 is shown on which a roll 12 of tape 14 is mounted for dispensing. The roll 12 is wound on a spool (not shown) supported between two spaced-apart frame members 30 and 32. Along with a backplate 34 mounted therebetween, the frame members 30 and 32 form what may be termed a frame assembly.

The tape 14 is fed from the spool to a guide drum 16 mounted between the frame members 30 and 32 at a forward end of the dispenser 10, and then travels in a rearward direction of the dispenser 10 to a smoothing iron 18 mounted between the lower edges of the frame members 30 and 32. Between the drum 16 and smoothing iron 18, the tape 14 passes beneath a pair of cantilevered paddles 20 that individually press each half of the tape 14 against the surfaces 22 of two boards 24 to which the tape 14 is simultaneously being applied, for reasons to be explained below. The tape 14 then passes beneath a serrated edge 26, with which the applied tape 14 can be severed from the tape 14 remaining on the dispenser 10.

Figure 2:
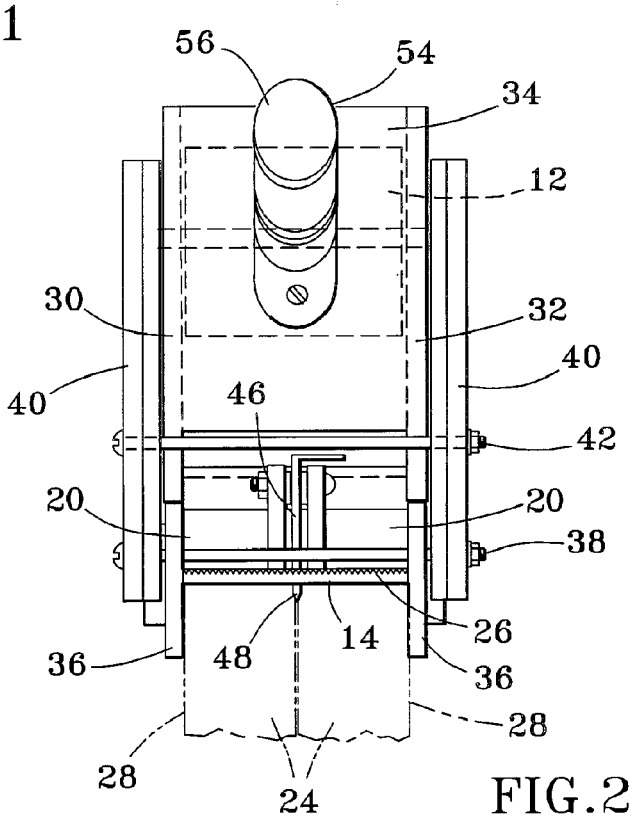

The dispenser 10 is equipped with moveable guides 36 mounted to the exteriors of the frame members 30 and 32 that enable the dispenser 10 (and therefore the tape 14 applied by the dispenser 10) to accurately follow one or both lateral sides 28 of the boards 24. The guides 36 are pivotably attached at their forward ends to their respective frame members 36, generally coinciding with the axis of the guide drum 16. The rearward end of each guide 36 is attached with a fastener 38 to a rail 40. A slot 44 is defined in the rail 40, and the rail 40 is secured to its respective frame member 30/32 by a fastener 42 (e.g., a knurled thumbnut) slidably residing within the slot 44. As a result, each rail 40 is moveable relative to its frame member 30/32, causing relative movement between the slot 44 and fastener 42 as the rearward end of the guide 36 moves upward and downward relative to its frame member 30/32. As seen in FIG. 2, both of the guides 36 are displaced below the lower edges of their respective frame members 30 and 32, thereby causing the dispenser 10 to track across the surfaces 22 of the boards 24. In this manner, the guides 36 help ensure that the tape 14 is applied straight on the surfaces 22 of the boards 24. The inside faces of the guides 36 slide against the sides of the boards 24, preventing the dispenser 10 from wobbling as it travels the lengths of the boards 24. Because the guides 36 are independently adjustable, either guide 36 can be raised and lowered to adapt to the particular width and thickness of a surface to which the tape 14 is being applied.

In FIG. 2, the dispenser 10 can be seen to simultaneously dispense one-half of the tape 14 on each of the boards 24. To facilitate separation of the boards 24 after application of the tape 14, the dispenser 10 is provided with a knife 46 adapted to form a longitudinal slit 48 in the tape 14, coinciding with the interface between the boards 24. The knife 46 is shown mounted with the smoothing iron 18 and projecting below the lower surface of the iron 18 to perform the slitting operation. The knife 46 is preferably mounted so that it can be raised out of the way, allowing the dispenser 10 to be used in applications where slitting of the tape 14 is not required.

The dispenser 10 is further equipped with windows 50 (only one is shown) radially oriented with the roll 12 of tape 14, with graduations 52 along the edges of the windows 52 to enable the user to estimate how much of the roll 12 remains. Finally, a handle 54 is attached to the backplate 34 by which the dispenser 10 can be held and operated. The distal end of the handle 54 preferably has an opening 56 through which an extension can be attached to allow the dispenser 10 to be used while the operator is standing.

Figure 3:
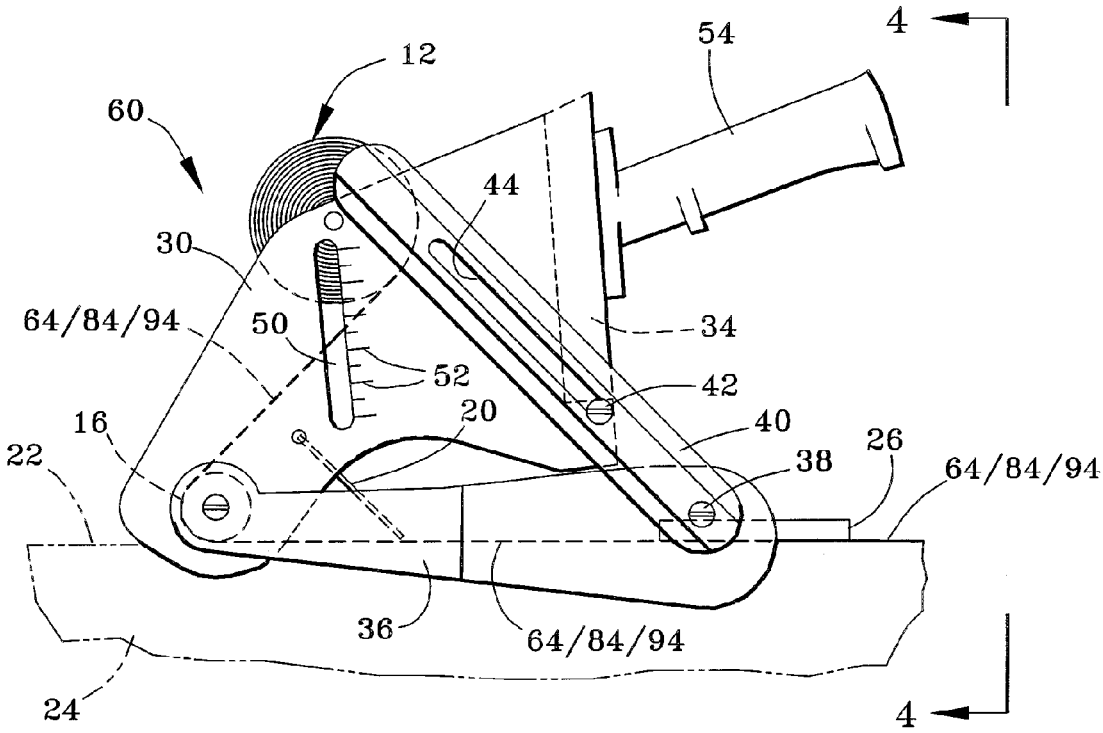
FIGS. 3 and 4 are side and rear views, respectively, of a tape dispenser in accordance with a first embodiment of this invention.
Figure 4:
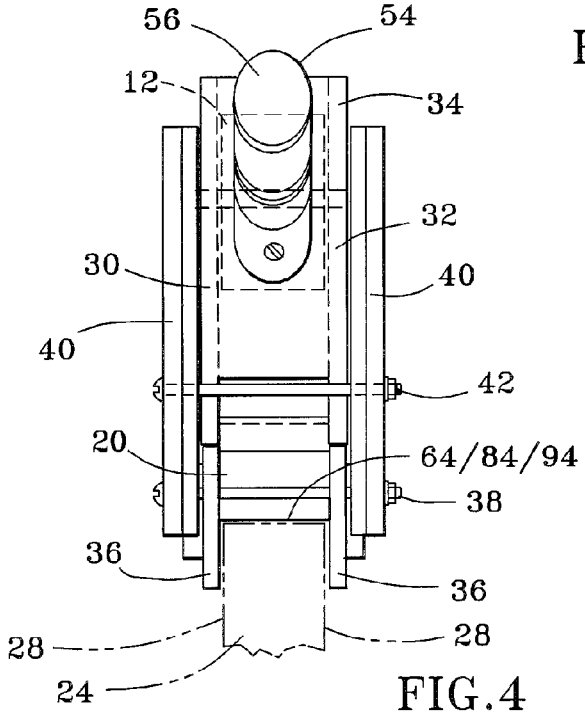

The dispenser 60 shown in FIGS. 3 and 4 differs from the dispenser 10 of FIGS. 1 and 2 primarily in its width and, therefore, the width of a tape 64, 84 and 104 dispensed with the dispenser 60. The different widths of the dispensers 10 and 60 can be achieved by assembling the dispensers 10 and 60 to have spools, guide drums 16, smoothing irons 18, a single paddle 20, serrate edges 26, and backplates 34 of appropriate widths —otherwise, identical components, such as the frame members 30 and 32, guides 36, rails 40, handle 54, etc. can be used in the construction of the dispensers 10 and 60. For reasons to be explained in reference to the tapes 14, 64, 84 and 104, the dispenser 10 of FIGS. 1 and 2 is preferably adapted to dispense a tape 14 having a width of about three inches, while the dispenser 60 of FIGS. 3 and 4 is preferably adapted to dispense a tape 64, 84 and 104 having a width of about one and one-half inches.

The dispensers 10 and 60 are adapted for dispensing various tapes 14, 64, 84 and 104, four preferred embodiments of which are represented in FIGS. 5 through 9. In each case, the tapes 14, 64, 84 and 104 provide symbols and numerical information that eliminate the need for other physically markings and measurements to locate and place of floor joists, wall studs, ceiling joists, and roof rafters during residential and commercial construction. The symbols and numerical information also eliminate measuring errors in certain phases of construction as described below. As noted above, the widths of the tapes 14, 64, 84 and 104 applied with the dispensers 10 and 60 are stated in British (US) units, though the widths could be stated in metric. Also, though widths of three inches and one and one-half inches are identified for the tapes 14, 64, 84 and 104, it will be evident from the following that appropriate widths for the tapes 14, 64, 84 and 104 will be based on the widths of the construction material used. Because standard materials include lumber with a stated thickness of two inches (e.g., 2×4 inch) but an actual thickness of 1.5 inches, the tapes 14, 64, 84 and 104 are described herein as having widths of either three inches (to simultaneously apply the 3-inch tape 14 to the sides of two boards) and one and one-half inches (to simultaneously apply the 1.5-inch tape 64, 84 or 104 to the side of a single board). In each case, the tape 14/64 is preferably self-adhesive and made of a flexible nonmetallic material that will not shrink, stretch, or expand, and is weather resistant. The adhesive preferably enables the tapes 14, 64, 84 and 104 to be applied to any essentially any clean surface, such as wood, plastic, metal, dry wall, paper, concrete, masonry, fiberboard such as Masonite®, tile, glass, or any other type of building material.

Each tape 14/64/84/104 is wound on its spool so that its symbols and numerical information are printed on a face side of the tape 14/64/84/104 opposite an adhesive on the backside of the tape 14/64/84/104. The tapes 14, 64, 84 and 104 are preferably made available prewound on their spools to allow installation of the tape rolls 12 as a unit on the dispensers 10 and 60. After installing the roll 12 of tape 14 in the dispenser 10, the tongue (beginning) of the tape 14 is threaded around the guide drum 16, under the flexible paddles 20, and under the smoothing iron 18. While the boards 24 are held together, the tape 14 is applied to their surfaces 22 by placing dispenser 10 on the surfaces 22 with the smoothing iron 18 resting on the surfaces 22 and both guides 36 straddling the lateral sides 28 of the boards 24. The distance beyond which the guides 36 project onto the sides 28 of the boards 24 can be adjusted and the secured with the fastener 42. As the tape 14 is applied to the surfaces 22 of the boards 24, the tape 14 is bonded to the surfaces 22 by pressure applied with the paddles 20, smoothed by the smoothing iron 18, and then cut at a desired length with the serrated edge 26.

Figure 5:
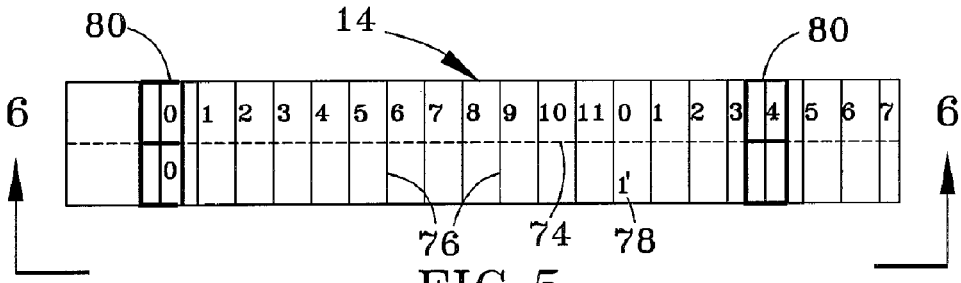
FIGS. 5 and 6 are plan and side views, respectively, of a tape for use with the dispenser of FIGS. 1 and 2.
Figure 6:
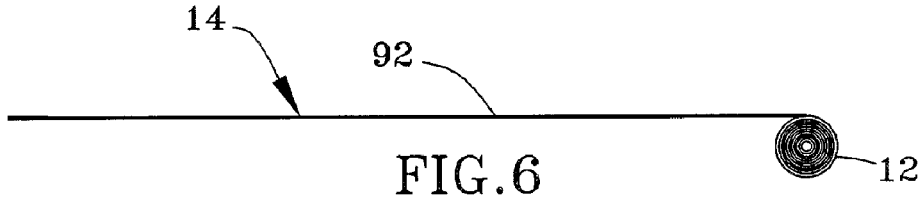

With reference to FIGS. 5 and 6, the tape 14 adapted for use on the dispenser 10 of FIGS. 1 and 2 is represented. As previously noted, the tape 14 is preferably three inches in width, with information on its face side 72 and an adhesive (not shown) on the oppositely-disposed backside of the tape 14. As seen in FIG. 5, the tape 14 can be seen to have perforations 74 along its length for the purpose of facilitating the separation operation performed by the knife 46 of the dispenser 10. The information on the face side 72 of the tape 14 is shown in FIG. 5 as two series of increments 76 and 78. The increments 76 of one increment series is spaced one inch apart, and the series repeats every twelve inches along the length of the tape 14. The increments 78 of the second increment series are spaced one foot apart and repeat every twelve feet along the length of the tape 14. An additional series of ½-inch increments may also be provided, identifying midpoints between the one-inch increments 76.

Figure 10:
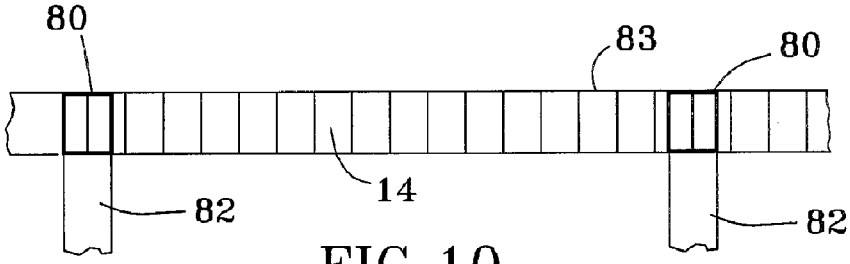
FIG. 10 represents the placement of wall studs against a ceiling plate 84 using one-half of the tape depicted in FIGS. 5 and 6.

The tape 14 is adapted specifically for use with the dispenser 10 to simultaneously mark the locations of wall studs on the ceiling and floor plates to which they are fastened, i.e., the boards 24 in FIG. 2 are ceiling and floor plates and the surfaces 22 to which the tape 14 is applied are the shorter sides of the plates. To locate the wall studs on the plates, the face side 72 of the tape 14 is further provided with rectangular symbols 80 at regular intervals along the length of the tape 14 and coinciding with the desired center spacing of the studs. In FIG. 5, the center spacing provided by the symbols 80 is sixteen inches, which is a conventional wall stud spacing in residential construction. However, the symbols 80 can be printed on the tape 14 to achieve any desired wall stud spacing. To coincide with the 1½-inch width of common construction lumber, the width of each symbol 80 is also about 1½ inches. The resulting placement of wall studs 82 against a ceiling plate 83 is depicted in FIG. 10, with the widths of the symbols 80 coinciding with the widths of the wall studs 82. Essentially the same configuration would be present where the wall studs 82 join the floor plate (not shown). The same procedure and dispenser 10 can be used on a concave or convex wall. The tape 14 would be applied to the upper edge of the curved radius segments, and the symbols 80 would show the exact locations for the wall studs 82 at the desired center spacing (e.g., sixteen inches).

Figure 7:
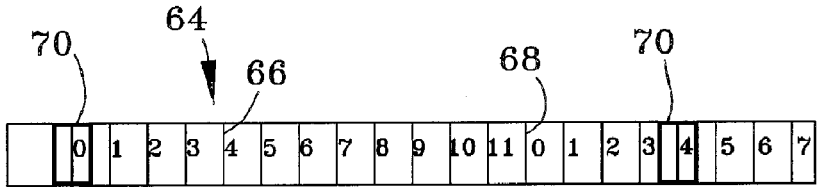
FIGS. 7, 8 and 9 are plan views of tapes for use with the dispenser of FIGS. 3 and 4.

A first tape 64 adapted for use with the dispenser 60 is shown in FIG. 7. As with the tape 14 of FIGS. 5 and 6, the tape 64 has information on its face side and an adhesive (not shown) on its backside. Also similar to the tape 14, the tape 64 shown in FIG. 7 has two series of increments 66 and 68, with the increments 66 spaced one inch apart and the series repeating every twelve inches along the length of the tape 64, and the increments 78 spaced one foot apart and repeating every twelve feet along the length of the tape 64. Finally, the tape 64 carries a series of rectangular symbols 70, whose spacings along the length of the tape 64 again coincide with the desired spacing of the lumber being located with the tape 64.

The tape 64 is adapted specifically for use with the dispenser 60 to mark the locations of floor joists, wall studs, ceiling joists, and common roof rafters on the boards to which they are to be fastened, i.e., the upper edge of a collar beam to locate the placement of floor joists to the collar beam, a top ceiling plate to locate the placement of ceiling joists to the ceiling plate, and to a ridge beam to locate the placement of common roof rafters to the ridge beam. For reference, the resulting placement of floor joints against a collar beam would appear as that shown in FIG. 10 (translated to a plan view), with the floor joists replacing the wall studs 82 and the collar beam replacing the plate 83.

Figure 8:
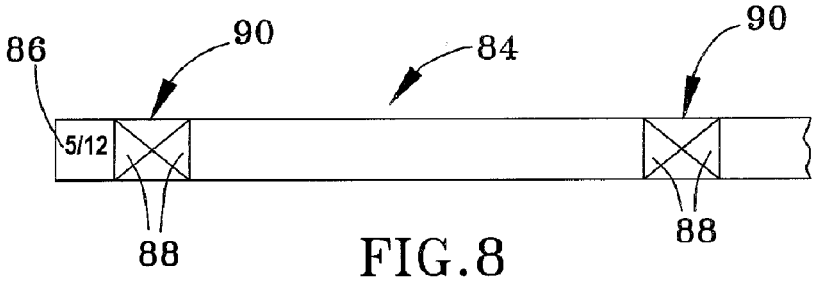

A second tape 84 adapted for use with the dispenser 60 is shown in FIG. 8. As with the previous tapes 14 and 64, the tape 84 has information on its face side and an adhesive (not shown) on its backside. In contrast to the previous tapes 14 and 64, the information on the tape 84 of FIG. 8 comprises the roof pitch (angle) 86 for which the tape 84 is intended and symbols 90 that are spaced along the length of the tape 84 to coincide with the desired location of the lumber being located with the tape 84. The tape 84 is adapted specifically to be applied to the upper (top) surface edge of a hip rafter or valley rafter for marking the locations of jack rafters on the face sides of the hip/valley rafter. Because hip and valley rafters are inclined at an angle determined by the roof pitch, the center-to-center spacing of the symbols 90 along the tape 84 will not equal the horizontal center-to-center spacing (e.g., sixteen inches) of jack rafters beneath a hip/valley rafter, and the end-to-end lengths of the symbols 90 will not equal the width (e.g., 1.5 inches) of the jack rafters. Instead, the spacing and lengths of the symbols 90 are determined by the pitch angle of the roof being constructed. For every different pitch angle for which the tape 84 is adapted, the spacing and lengths of the corresponding symbols 90 will differ. To facilitate locating the placement of the abutting ends of jack rafters against the face sides of a hip/valley rafter, each symbol 90 is shown as comprising two identical triangles 88 that contact each other at a single corner and are separated from each other by a line of symmetry (transverse to the length of the tape 84). In this manner, the intersection of the triangles 88 mark the center of the symbol 90.

Use of the dispenser 60 with the tape 84 would be essentially identical to that described previously. The tape 84 should be applied with one of the symbols 90 at a certain point near the top of the hip or valley rafter. The tape 84 is then continuously applied to a point near the "bird's mouth," at which point the tape 4 is cut.

Figure 9:
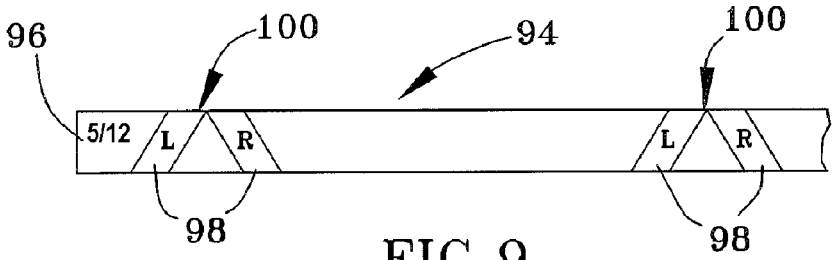

A third tape 94 adapted for use with the dispenser 60 is shown in FIG. 9. The tape 94 shares similarities with all of the preceding tapes 14, 64, and 84, particularly the tape 84 of FIG. 8. As before, the tape 94 has information on its face side and an adhesive (not shown) on its backside. As with the tape 84, the information on the tape 94 of FIG. 9 comprises the roof pitch (angle) 96 for which the tape 94 is intended and symbols 100 that are spaced along the length of the tape 94 to coincide with the desired location of the lumber being located with the tape 94. The tape 94 is adapted specifically to be applied to the upper (top) surface edge of a gable end rafter for marking the locations of jack studs on the face sides of the gable end rafter. As such, the distance between adjacent symbols 100 is again determined by the pitch angle of the roof, and the distance between symbols 100 will be different for every different roof pitch angle. In order to precisely locate the placement of the abutting ends of jack studs against the face sides of a gable end rafter, each symbol 100 is shown as comprising two identical parallelograms 98 that contact each other at a single corner and are separated from each other by a line of symmetry (transverse to the length of the tape 94). Each parallelogram 98 of the symbol 100 has a transverse width equal to the width of the lumber being used (e.g., 1½ inches), and the angle between the parallelograms 98 equals the pitch angle of the roof. The lefthand parallelogram 98 is marked "L" and the righthand parallelogram 98 is marked "R" in FIG. 9 to associate each parallelogram 98 with either the left or right side of the gable end rafter. In this manner, each parallelogram 98 coincides with the placement of an abutting end of a jack stud, depending on which Use of the dispenser 60 with the tape 94 differs from that described previously. The tape 94 is applied to the lower face sides of the left and right gable end rafters while the rafters lie flat. To apply the tape 94 to the left rafter, the guides 36 are freed for movement and the dispenser 60 is placed on the upper face of the rafter with the left guide 36 of the dispenser 60 in a downward position so as to contact the lateral side surface of the rafter, while the right guide 36 rests on the surface of the rafter to which the tape 94 is being applied. The guides 36 are then secured with the fasteners 42, and the tape 94 is applied. To apply the tape 94 to the right side of the gable end rafter, the left and right rafters are brought together so that the locations of the symbols 100 on the right rafter can be aligned with the symbols 100 on the left rafter. The tape application procedure described for the left rafter is then repeated except that the left guide 36 will rest on the surface of the rafter and the right guide 36 will contact the lateral side surface of the rafter.

While the invention has been described in terms of a preferred embodiment, it is apparent that other forms could be adopted by one skilled in the art. Therefore, the scope of the invention is to be limited only by the following claims.

What is claimed is:

1. A tape dispenser system for applying an adhesive tape to a surface, the tape dispenser system comprising:

a frame comprising spaced-apart members, the frame having a lower forward end in a forward direction of the frame and a lower rearward end in an oppositely-disposed rearward direction of the frame, each of the spaced-apart members having a lower edge;

a roll of an adhesive tape rotatably mounted between the spaced-apart members so that the tape is dispensed from the roll and travels from the forward end to the rearward end of the frame, the tape having symbols and numerical information along a length thereof;

means for guiding the frame and inhibiting wobbling of the frame when traveling on the surface and applying the tape to the surface, the guiding means comprising lateral guides independently pivotably attached to the spaced-apart members of the frame, each of the lateral guides being attached so that a portion thereof is pivotable to positions below the lower edge of its respective spaced-apart member independently of the other of the lateral guides such that either or both of the lateral guides can be selectively pivoted to the positions below the lower edges of their respective spaced-apart members to thereby define means for sliding against at least one lateral side of the surface;

a resilient member disposed between the lower edges of the spaced-apart members and applying a downward pressure on the tape traveling from the forward end to the rearward end of the frame;

means for severing the tape at the rearward end of the frame; and a handle attached to the frame for pushing the frame in the forward direction.

2. The tape dispenser system according to claim 1, further comprising a window defined in at least one of the spaced-apart members through which the roll of adhesive tape can be viewed for assessing how much of the tape remains on the roll.

3. The tape dispenser system according to claim 1, wherein each of the lateral guides is pivotably attached to a forward end thereof to its respective space-apart member and the portion that is pivotable to a position below the lower edge of its respective spaced-apart member is a rearward end thereof.

4. The tape dispenser system according to claim 3, wherein the rearward end of each of the lateral guides is attached to its respective space-apart member with means for enabling the rearward end of the lateral guide to be raised and lowered relative to the lower edge of its respective spaced-apart member.

5. The tape dispenser system according to claim 4, further comprising means for securing the rearward ends of the lateral guides with respect to their respective spaced-apart members.

6. The tape dispenser system according to claim 1, wherein the tape is formed of a flexible nonmetallic material that is shrink-resistant, stretch-resistant, and weather-resistant.

7. The tape dispenser system according to claim 1, wherein the handle comprises means for attaching an extension thereto.

8. The tape dispenser system according to claim 1, wherein the spaced-apart frame members are parallel and spaced apart a distance of about three inches and the tape is about three inches wide.

9. The tape dispenser system according to claim 1, wherein the spaced-apart frame members are parallel and spaced apart a distance of about 1.5 inches and the tape is about 1.5 inches wide.

10. The tape dispenser system according to claim 1, wherein the symbols and the numerical information of the tape comprise means for locating positions of floor joists, ceiling joists, and common roof rafters on sixteen-inch centers when the tape is applied to collar beams, ceiling plates, and ridge beams, respectively.

11. The tape dispenser system according to claim 10, wherein the numerical information comprises first and second series of increments, increments of the first series of increments are spaced one inch apart and repeat every twelve inches along the length of the tape, increments of the second series of increments are spaced one foot apart and repeat every twelve feet along the length of the tape.

12. The tape dispenser system according to claim 10, wherein the symbols are spaced about sixteen inches apart to position the floor joists, ceiling joists, and common roof rafters on sixteen-inch centers and each of the symbols has a length of about 1.5 inches in a direction along the length of the tape to coincide with abutting widths of the floor joists, ceiling joists, and common roof rafters.

13. The tape dispenser system according to claim 10, wherein the symbols have identical rectangular shapes.

14. The tape dispenser system according to claim 1, wherein the symbols and the numerical information of the tape comprise means for locating positions of jack rafters on sixteen-inch centers when the tape is applied to hip and valley rafters.

15. The tape dispenser system according to claim 14, wherein the numerical information consists of a roof pitch value.

16. The tape dispenser system according to claim 15, wherein the symbols are spaced apart along the length of the tape on the basis of the roof pitch value to position the jack rafters on sixteen-inch centers and each of the symbols has a length in a direction along the length of the tape on the basis of the roof pitch value to coincide with abutting widths of the jack rafters.

17. The tape dispenser system according to claim 14, wherein the symbols have identical shapes comprising two identical triangles contacting each other at a single corner and separated from each other by a line of symmetry.

18. The tape dispenser system according to claim 1, wherein the symbols and the numerical information of the tape comprise means for locating positions of jack studs on sixteen-inch centers when the tape is applied to a gable end rafter.

19. The tape dispenser system according to claim 18, wherein the numerical information consists of a roof pitch value.

20. The tape dispenser system according to claim 19, wherein the symbols are spaced apart along the length of the tape on the basis of the roof pitch value to position the jack studs on sixteen-inch centers and each of the symbols has a length in a direction along the length of the tape on the basis of the roof pitch value to coincide with abutting widths of the jack studs.

21. The tape dispenser system according to claim 20, wherein the symbols have identical shapes comprising two identical parallelograms contacting each other at a single corner and separated from each other by a line of symmetry.

22. The tape dispenser system according to claim 21, wherein the parallelograms define an angle therebetween that is substantially equal to the roof pitch value.

23. A tape dispenser system for applying an adhesive tape to a surface, the tape dispenser system comprising:

a frame comprising spaced-apart members, the frame having a lower forward end in a forward direction of the frame and a lower rearward end in an oppositely-disposed rearward direction of the frame, each of the spaced-apart members having a lower edge:

a roll of an adhesive tape rotatably mounted between the spaced-apart members so that the tape is dispensed from the roll and travels from the forward end to the rearward end of the frame, the tape having symbols and numerical information along a length thereof;

lateral guides pivotably attached to the spaced-apart members of the frame, each of the lateral guides being attached so that a portion thereof is pivotable to a position below the lower edge of its respective spaced-apart member; each of the lateral guides is pivotably attached to a forward end thereof to its respective spaced-apart member and the portion that is pivotable to a position below the lower edge of its respective spaced-apart member is a rearward end thereof;

a resilient member disposed between the lower edges of the spaced-apart members and applying a downward pressure on the tape traveling from the forward end to the rearward end of the frame;

means for slitting the tape lengthwise to form a pair of tape portions of approximately equal width as the tape travels from the forward end to the rearward end of the frame;

means for severing the tape at the rearward end of the frame; and a handle attached to the frame for pushing the frame in the forward direction.

24. The tape dispenser system according to claim 23, wherein the tape has perforations along the length thereof and the slitting means slits the tape along the perforations.

25. The tape dispenser system according to claim 23, wherein the slitting means comprises a blade coupled to the resilient member and mounted so as to be selectively engaged and disengaged with the tape.

26. The tape dispenser system according to claim 23, wherein each of the tape portions has symbols and the numerical information along the length thereof.

27. The tape dispenser system according to claim 26, wherein the symbols and the numerical information of each of the tape portions comprise means for locating positions of wall studs on sixteen-inch centers when the tape portions are applied to floor and ceiling plates.

28. The tape dispenser system according to claim 27, wherein the numerical information of each of the tape portions comprises first and second series of increments, increments of the first series of increments are spaced one inch apart and repeat every twelve inches along the length of the tape, increments of the second series of increments are spaced one foot apart and repeat every twelve feet along the length of the tape.

29. The tape dispenser system according to claim 27, wherein the symbols are spaced about sixteen inches apart to position the wall studs on sixteen-inch centers and each of the symbols has a length of about 1.5 inches in a direction along the length of the tape to coincide with abutting widths of the wall studs.

30. The tape dispenser system according to claim 27, wherein the symbols have identical rectangular shapes.

* * * * *